US008025067B2

(12) United States Patent
Thorpe et al.

(10) Patent No.: US 8,025,067 B2
(45) Date of Patent: Sep. 27, 2011

(54) DISPLACEMENT SIFTER

(75) Inventors: Timothy Thorpe, Santa Monica, CA (US); Luis Alviar, Santa Monica, CA (US)

(73) Assignee: HCT Asia, Ltd, Central (HK)

( * ) Notice: Subject to any disclaimer, the term of this patent is extended or adjusted under 35 U.S.C. 154(b) by 654 days.

(21) Appl. No.: 12/022,062

(22) Filed: Jan. 29, 2008

(65) Prior Publication Data

US 2009/0188517 A1 Jul. 30, 2009

(51) Int. Cl.
*A45D 33/02* (2006.01)
*A47J 43/22* (2006.01)

(52) U.S. Cl. ..... 132/307; 209/372

(58) Field of Classification Search ..... 132/306, 132/307, 293; 222/182, 480, 548, 565, 485, 222/524, 544; 209/370, 372, 373
See application file for complete search history.

(56) References Cited

U.S. PATENT DOCUMENTS

| | | | | |
|---|---|---|---|---|
| 1,357,306 | A * | 11/1920 | Aste | 132/307 |
| 5,975,368 | A * | 11/1999 | Wood | 222/151 |
| 7,494,030 | B2 * | 2/2009 | Bennett | 222/480 |
| 2006/0097011 | A1 * | 5/2006 | Kou | 222/153.11 |
| 2007/0228079 | A1 | 10/2007 | Vogel et al. | |

FOREIGN PATENT DOCUMENTS

GB 2446039 7/2008

OTHER PUBLICATIONS

Search Report for Application No. 0807785.1, Mailed on Sep. 8, 2008, 3 pages.

* cited by examiner

*Primary Examiner* — Rachel R Steitz
(74) *Attorney, Agent, or Firm* — Lee & Hayes, PLLC

(57) ABSTRACT

A sifting apparatus and container for storing and dispensing material, such as cosmetic powder are described. Two sifters are arranged so their holes are not aligned, and a resilient material is placed between the sifters to create a gap that allows powder to pass out from a storage cavity to a surface accessible by the user. In a second configuration, at least one of the sifters is displaced toward the other sifter to reduce or eliminate the gap, thus reducing or preventing the flow of material through the sifters.

24 Claims, 14 Drawing Sheets

DISPLACEMENT SIFTER

BACKGROUND

Cosmetic materials such as those used for cosmetic foundation are typically provided as a compacted or a loose powder. Loose materials, including loose powder, are becoming more common due in part to the fact that loose material provides improved coverage of the material on a surface. The loose material may be provided in a container with a perforated surface or sifter so that the powder is shaken out of the perforations and the powder can be applied onto an applicator. This configuration is problematic in that the loose material has a tendency to move up through the perforations during handling and/or jostling of the container, such as the movements associated with carrying the container in a handbag, pocket, or purse. The loose material may deposit above the perforated surface and/or on the cap and may at least partially spill out when the container is opened.

SUMMARY

This disclosure relates to sifters and containers usable for holding, retaining, and/or dispensing material, among other things, powdered or powder-like cosmetic products. According to one implementation, a sifting apparatus is disclosed having a first sifter, a second sifter engaged with the first sifter such that a gap is present between a portion of the first sifter and a portion of the second sifter to permit material to pass through the first sifter, the second sifter, and the gap; and a displacement mechanism to displace the second sifter toward the first sifter to prevent the flow of the material through the first sifter, the second sifter, and the gap.

Containers are also disclosed that have a base, a first sifter, a second sifter and a cover. The first sifter may be engaged with the base and may have at least one sifting hole for sifting materials that have a powder-like consistency. A second sifter may be engaged with the first sifter and may have at least one sifting hole. The two sifters are engaged so that the sifting holes are not in direct alignment. A gap is present between at least a potion of the two sifters which allows material to flow through both sifters and the gap. When the second sifter is displaced towards the first sifter, such as when the cover is engaged with the base, the gap is reduced and thereby restricts the flow of material. A resilient material or spring may be used to create and/or maintain the gap when the cover is removed.

Several methods for filling the disclosed containers are also disclosed.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical items.

DETAILED DESCRIPTION

Containers having displacement sifter mechanisms will now be described with reference to the figures. The sifter mechanism may have one or more sifters, each sifter having one or more holes. The holes in the sifter may be uniform or varied both in size, topography, shape, and so forth. While the disclosure is described in the context of sifters for powdered cosmetics products, the displacement sifter mechanisms may be useful for other powdered or powder-like products, such as baby powder, foot powder, medicinal powders, and the like. They may also be useful for handling liquids and other non-powdered material.

Figure 1:
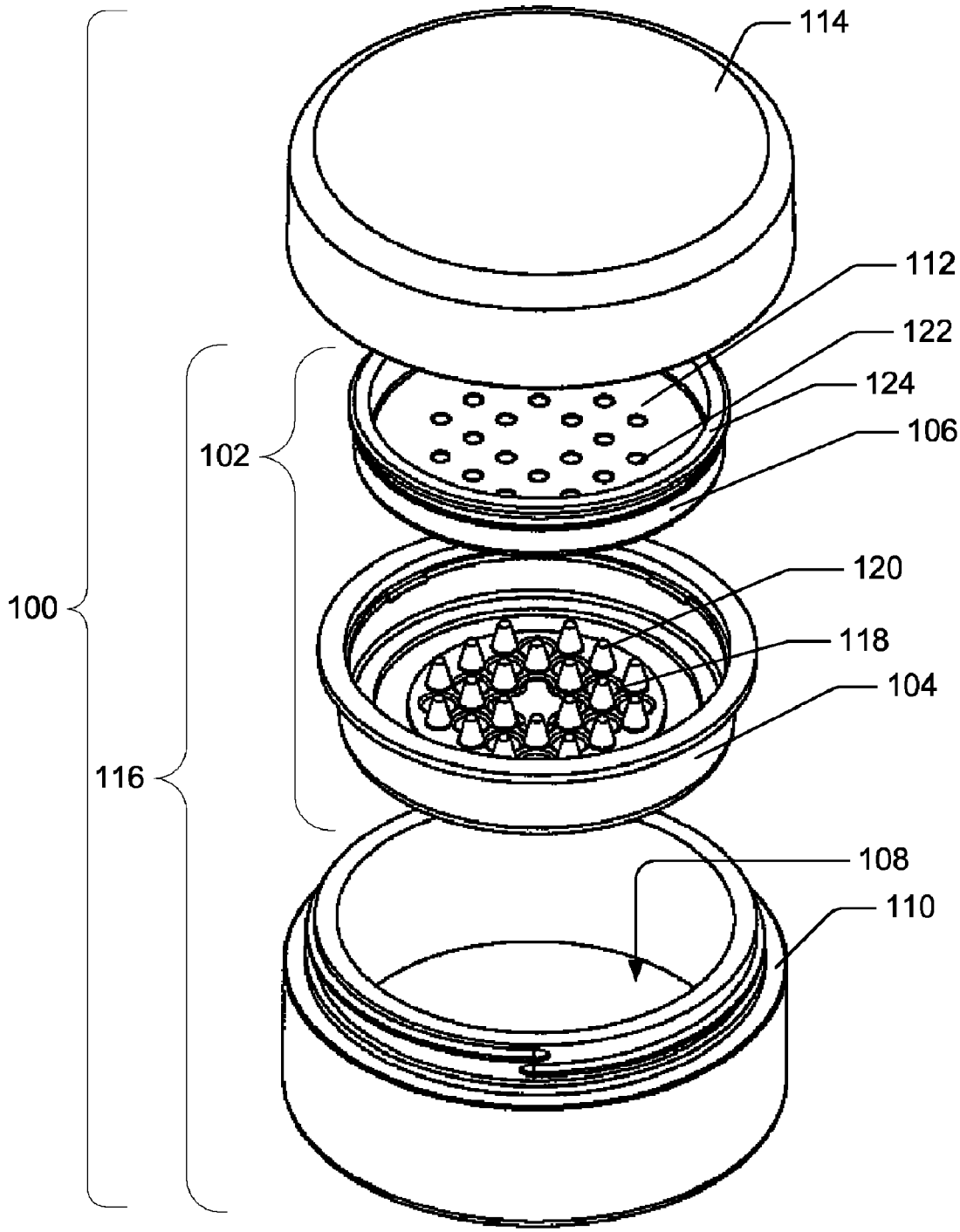
FIG. 1 shows an exploded view of a container having a compression sifter, according to one exemplary implementation.

FIG. 1 shows an exploded view of a container 100 having a displacement sifter mechanism according to one exemplary implementation. IN this configuration, the displacement sifter mechanism may be referred to as a compression sifter as a compression member may be placed between two sifter portions. In a displacement sifter 102, a gap between portions of the first sifter 104 and a second sifter 106 provides a pathway for material to pass between the storage cavity 108 in a base 110 and the dispensing surface 112. When the sifters are displaced toward one another, this gap is reduced, which obstructs the pathway and thus prevents material from being passed by the sifters. The displacement may be provided by pressure from a cover 114 engaging a bottom portion 116 comprising the base 110, the first sifter 104, and the second sifter 106, through engagement with a lever or cam, by rotating a threaded member, or through any other suitable displacement mechanism.

The container 100 may be provided with a first sifter 104 engaged with the base 110 in such a fashion as to leave a storage cavity 108. The first sifter 104 may be integral to the base or may be secured or fixed to the base 110 by friction, glue, threaded engagement, ribs or other contoured features, or other suitable means.

The first sifter 104 may have one or more holes 118 for sifting loose material, such as facial powder, makeup, or the like, stored within the storage cavity 108. The first sifter 104 may also have one or more protrusions 120 extending toward and aligned with holes 122 in the second sifter 106. Here the protrusions 120 are shown shaped as truncated cones; however they may be in any suitable shape including cones, cylinders, pyramids, hemispheres, cubes, and so forth.

The second sifter 106, which is engaged with the first sifter 104, may have a circumferential rim 124 and an upper surface 112 for dispensing and/or retrieving material via the holes 122. Although not shown, the second sifter 106 may also have protrusions aligned with the holes 118 in the first sifter 104 A cover 114 may be removably affixed to any portion of the bottom portion 116.

The base 110 may be filled with material in several ways. For example, the storage cavity 108 in base 110 may be filled with material, then the first sifter 104 and remaining components are assembled.

Figure 2:
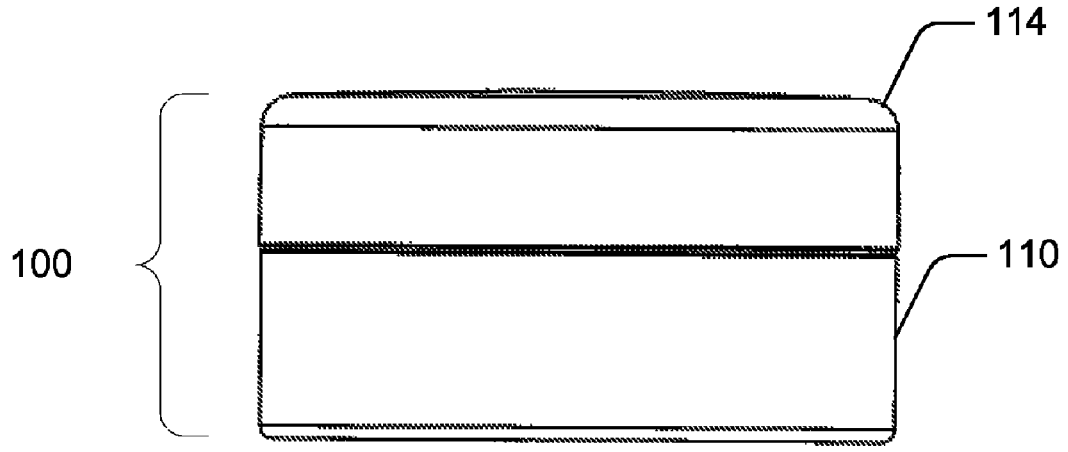
FIG. 2 shows an elevational view of the container of FIG. 1 in its closed position.

FIG. 2 shows an elevational view of the container 100 of FIG. 1 in its closed position wherein the cover 114 and base 110 are proximate and engaged. As shown in FIGS. 1-5, the cover 114 is secured to the base 110 using threads; however the cover 114 may be secured to the base 110, or to a potion of the bottom portion 136, using a rib, groove, hinge, clasp, latch, or other suitable means.

Figure 3:
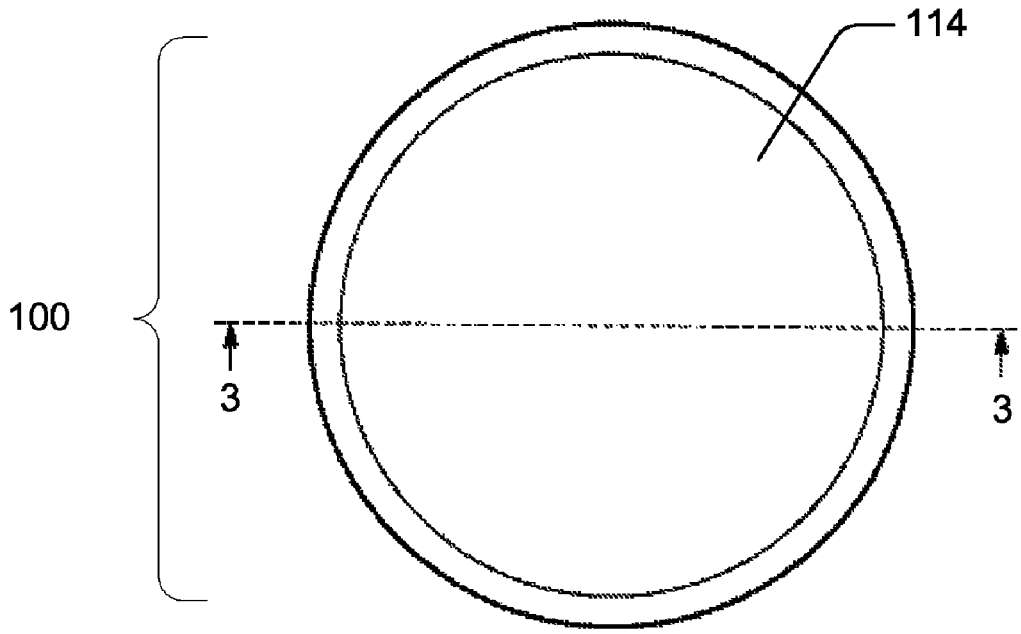
FIG. 3 shows a top plan view of the container of FIG. 1.

FIG. 3 shows a top plan view of the cover 114 of the container of FIG. 1. Other shapes for the container are also possible. For example, the container 100, or any portion thereof, may be round, elliptical, triangular, cubical, conical, spherical, or other shape suitable for mounting the sifters and providing a storage cavity.

Figure 4:
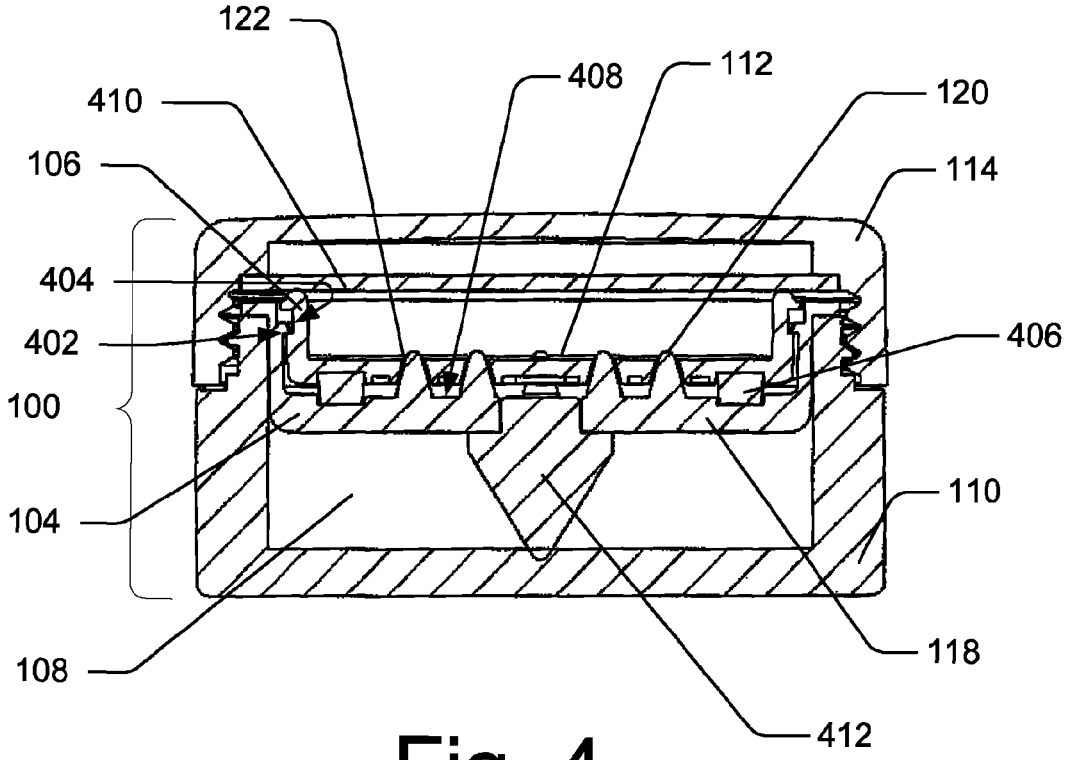
FIG. 4 shows a cross-sectional view of the container of FIG. 1, taken along line 3-3 in FIG. 3, when in the closed position.

FIG. 4 shows a cross-sectional view of the container of FIG. 1 in the "closed" position. The second sifter 106 may be secured to the first sifter 104 by friction or other suitable means. Additionally or alternatively, one or more ribs, or tabs 402 on the first sifter 104 may be configured to engage with one or more grooves 404 in the second sifter 106. Groove 404 may be a generally circular groove along the outer circumference of second sifter 106.

As shown in FIG. 4, the holes 122 in the second sifter 106 are aligned with protrusions 120 which extend from the first sifter 104 towards the second sifter 106. The pressure from the cover 114 in a closed position upon the circumferential rim 124 or other portion of the second sifter 106 compresses a resilient material 406 forcing the second sifter 106 towards the first sifter 104, and causes the protrusions 120 to occlude holes 122 and thus prevent material from passing from the storage cavity 108 onto the upper surface 112 of the second sifter 106. Additionally or alternatively, the holes 122 from the first sifter 104 may be misaligned with the holes 118 in the second sifter 106 so that the sifter components themselves provide the occlusion. Upon displacement of the sifters 106 and 104, such as by affixing the cover 114, the first and second sifters 106 and 104 would come into contact with, or closer proximity to, each other and prevent material from traveling through the sifter holes 122 and/or 118 and/or gap 408.

The resilient material 406 may be a co-molded thermoplastic elastomer (TPE) or other suitable material and may be molded, extruded, and/or formed according to other conventional methods. When embodied as a generally circumferential ring, the resilient member 406 may also deform and seal a gap 408 between the first sifter 104 and the second sifter 106. The resilient material 406 may be formed on the side of the second sifter 106 facing the first sifter 104. The resilient material 406 may alternatively be provided on the first sifter 104 on the side facing the second sifter 106, or as a separate component entirely. The displacement caused by the displacement mechanism, such as cover 114, may elastically alter, compress, and/or deform the resilient material 406. When the displacement mechanism is disengaged, the resilient material, may recover, decompress, and/or elastically return to a less compressed, altered and/or deformed state as described with reference to FIG. 5. The resilient material may have in whole or part elastic or semi-elastic properties.

The cover 114 may have a sealing layer 410 engaged with or integral to the cover 114 for pressing or touching the second sifter 106 to further prevent the unintentional spillage of powder or other material from container 100. Alternatively, there may be a sealing layer affixed to the circumferential rim 124. The sealing layer 410 may be waxed paperboard, Teflon, TPE, or other suitable material.

A supporting member 412 may extend from the first sifter 104 to the base 110. Base 110, first sifter 104, second sifter 106, and cover 114 may be constructed of polypropylene, metal, plastic, wood, or other suitable material and may be molded or formed according to conventional methods.

Figure 5:
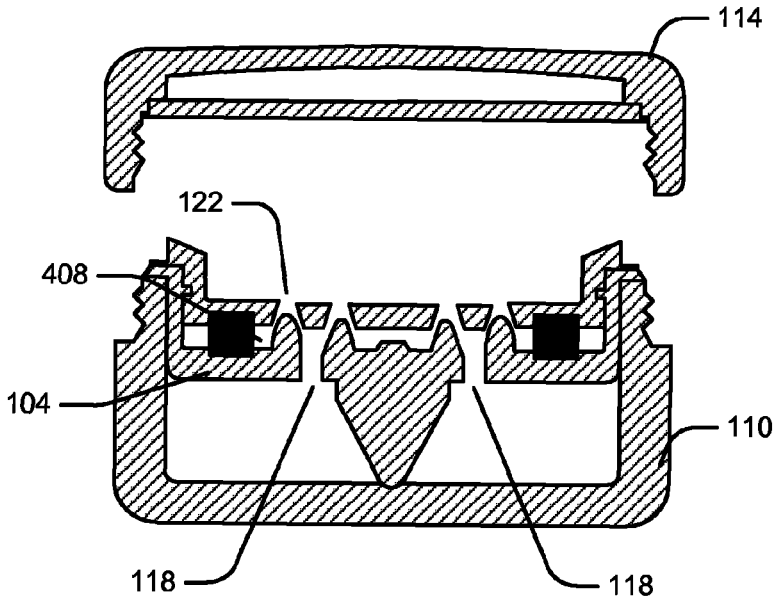
FIG. 5 shows a cross-sectional view of the container of FIG. 1, taken along line 3-3 in FIG. 3, when in the open position.

FIG. 5 shows a cross-sectional view of the container of FIG. 1, taken along line 3-3 in FIG. 3, in the open position with cover 114 removed. The cover 114 no longer presses second sifter 104; thus, the resilient material 406 recovers, decompresses, and/or elastically returns to a less compressed, altered and/or deformed state to separate the first sifter 104 and the second sifter 106, creating or expanding gap 408 between them. Material may thus flow freely from the storage cavity 108 via the holes 118 in the first sifter 104 and the holes 122 in the second sifter 106 to the upper surface 112 of the second sifter 106.

Figure 6:
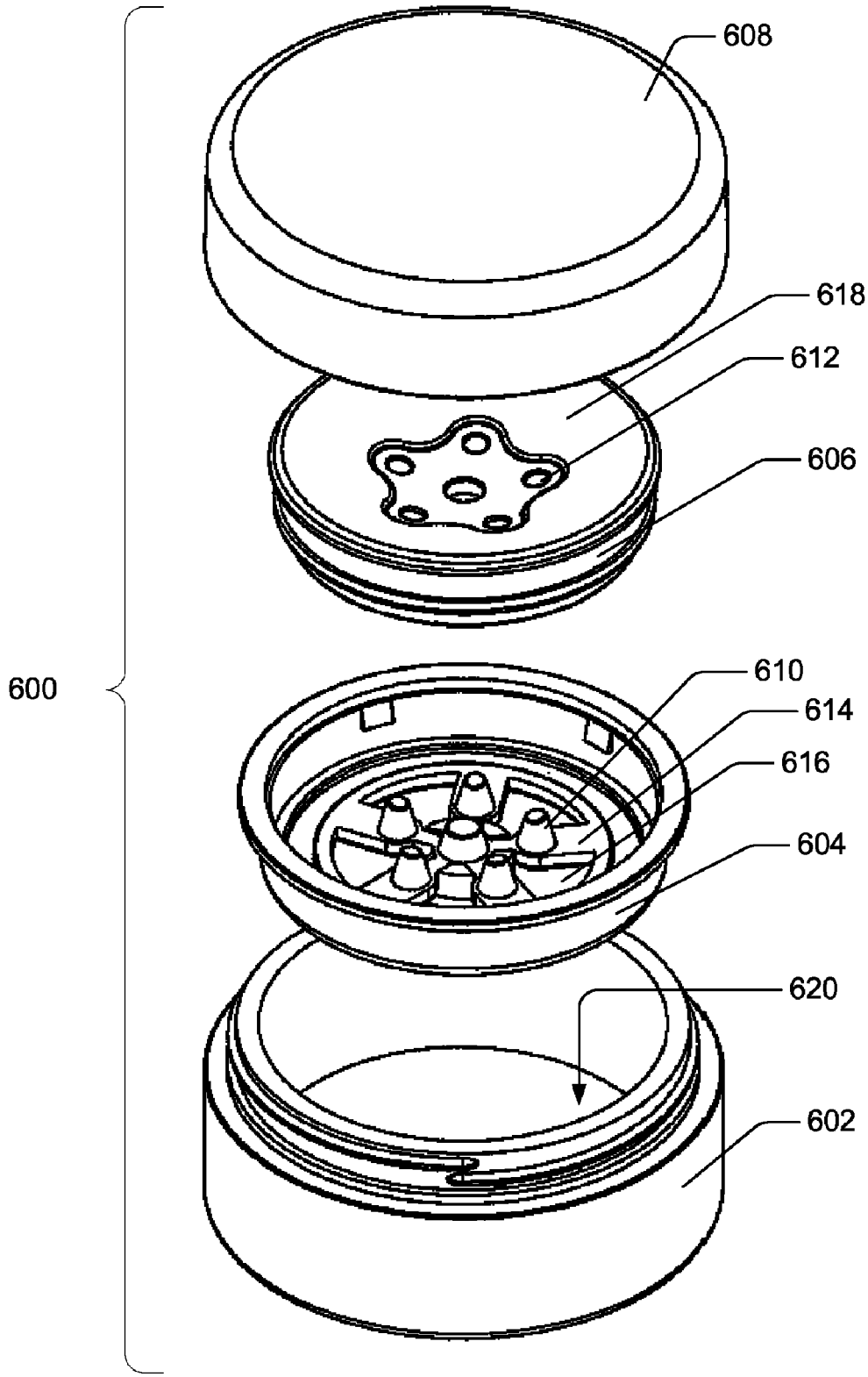
FIG. 6 shows an exploded view of a container having a compression sifter, according to another exemplary implementation.

Like the configuration shown in FIG. 1, FIG. 6 shows another exemplary implementation in an exploded view of a container 600 with a base 602, first sifter 604, second sifter 606, and cover 608. This implementation differs from that shown in FIG. 1 in that the protrusions 610 on the first sifter 604 are larger to accommodate the larger holes 612 in the second sifter 606. Additionally, the first sifter 604 in this embodiment has support arms 614 for the protrusions 610 extending radially from the center to the rim, providing larger holes 616 in the first sifter 604. The protrusions 610 may obscure the holes 612, with or without extending beyond the surface 618 of the second sifter 606 to prevent material from passing between the storage cavity 620 and the surface 618 of the second sifter 606. Additionally or alternatively, material may be prevented from passing between the storage cavity and the surface 618 of the second sifter 606 by misaligning the holes 612 in the second sifter 606 with the holes 616 in the first sifter 604.

Figure 7:
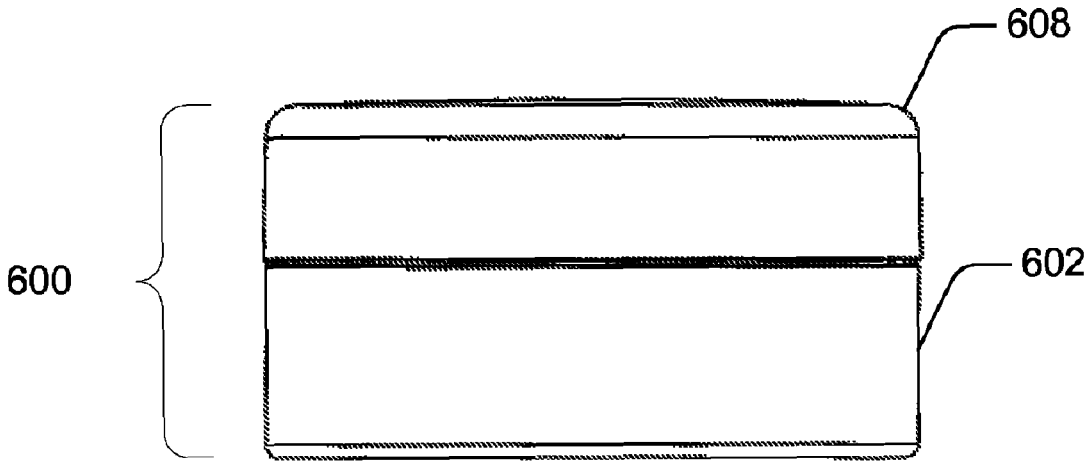
FIG. 7 shows an elevational view of the container of FIG. 6, when in the closed position.

FIG. 7 shows an elevational view of the container of FIG. 6, when in the closed position.

Figure 8:
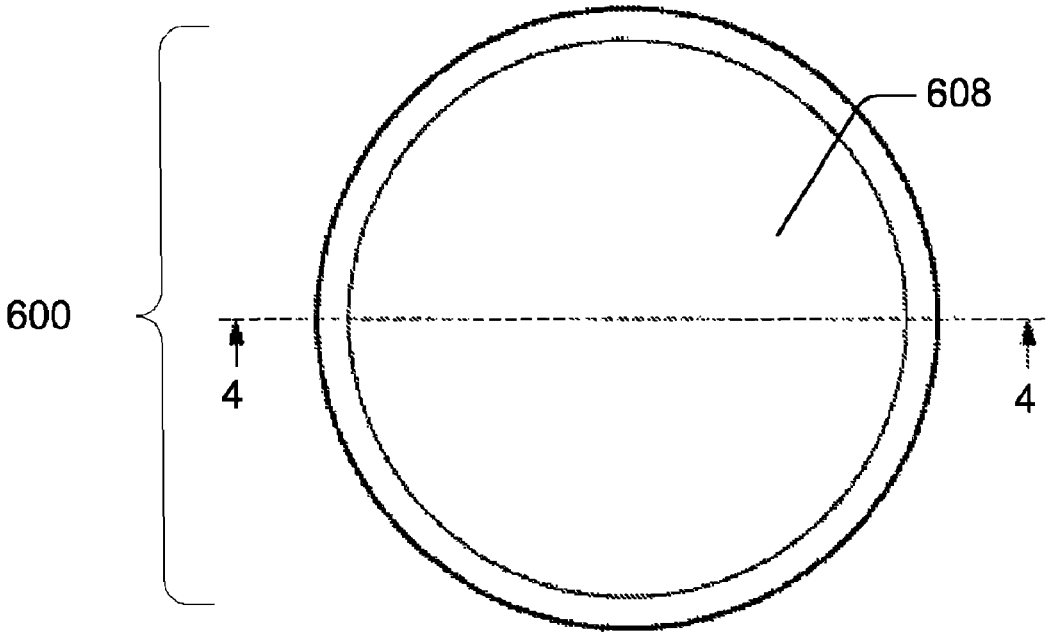
FIG. 8 shows a top plan view of the container of FIG. 6.

FIG. 8 shows a top plan view of the container of FIG. 6.

Figure 9:
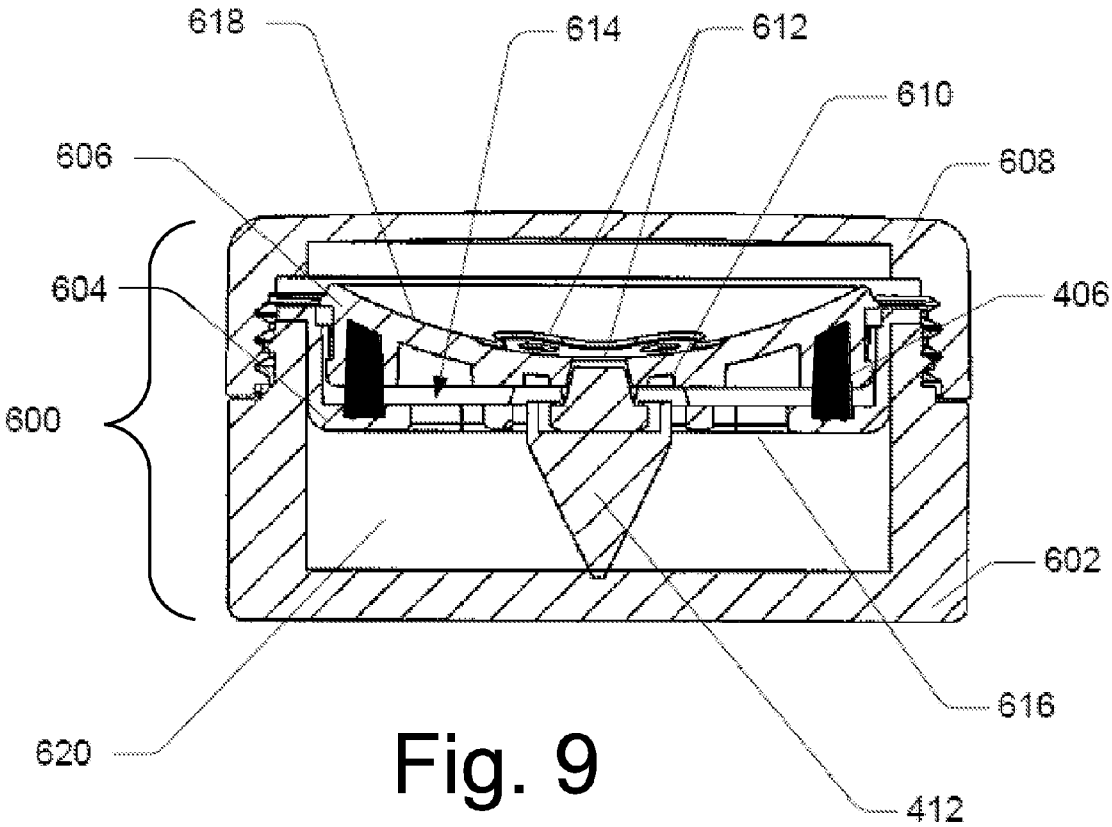
FIG. 9 shows a cross-sectional view of the container of FIG. 6, taken along line 4-4 in FIG. 8, when in the closed position.

FIG. 9 shows a cross-sectional view of the container of FIG. 6, taken along line 4-4 in FIG. 8, when in the closed position.

Figure 10:
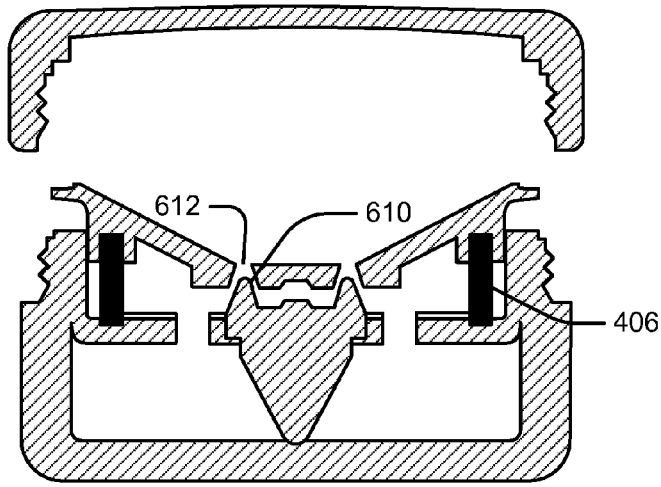
FIG. 10 shows a cross-sectional view of the container of FIG. 6, taken along line 4-4 in FIG. 8, when in the open position.

FIG. 10 shows a cross-sectional view of the container of FIG. 6, taken along line 4-4 in FIG. 8, when in the open position.

Additionally, the implementation shown in FIGS. 6-10 also illustrates how the upper surface 618 of the second sifter, such as second sifter 606, may be concave. This upper surface 618 may assist in directing powder or other material into the one or more holes 612 and, thus, into the storage cavity 620. This concave or sloped surface 618 may reduce the amount of powder or other material above the second sifter 606 when the container 600 is held in an upright position, such as when a user is preparing to close the container 600. Additionally or alternatively, the concavity of the upper surface 618 may aid in collecting the material for an application, such as for engaging the material with a brush or other applicator. Reducing the amount of powder above the second sifter 606 may reduce the amount of powder that may be spilled while the container 600 is closed or when the container 600 is initially opened.

Figure 11A:
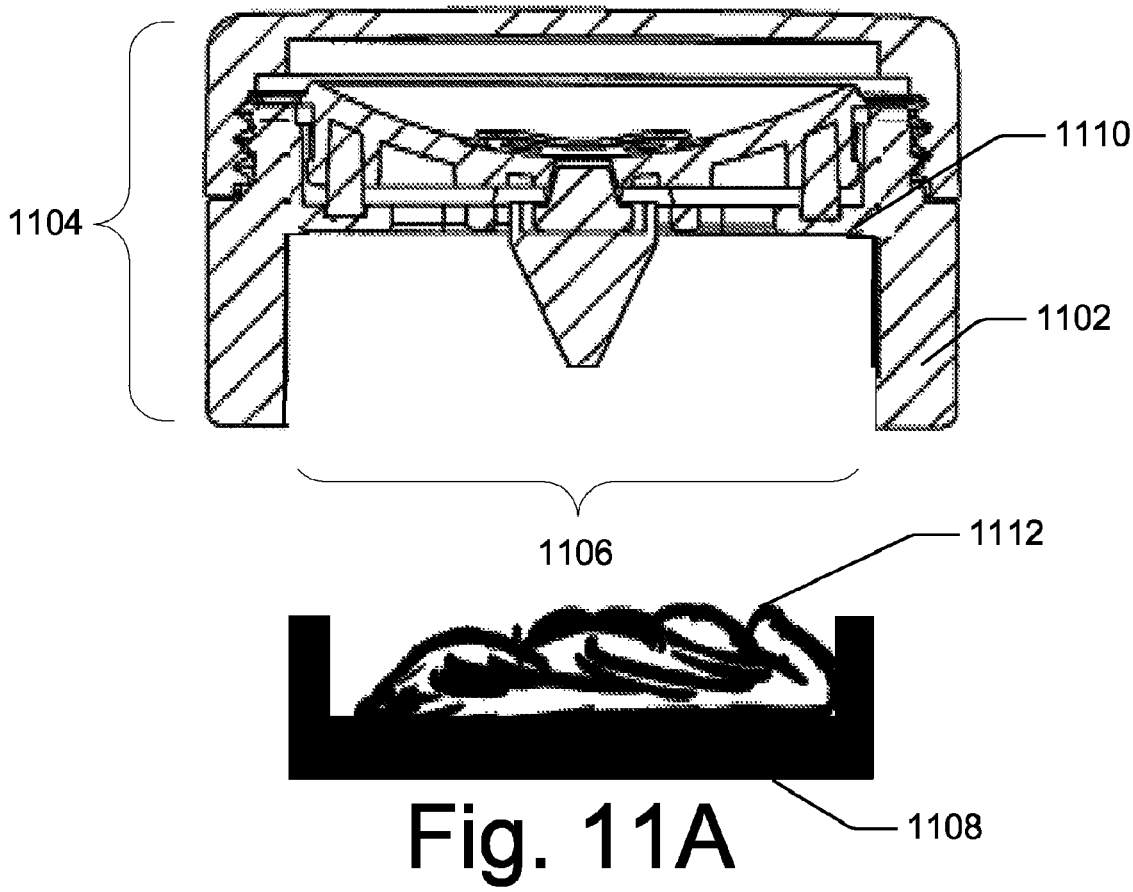
FIGS. 11A and 11B depict an alternate configuration utilizing a cartridge to assist filling the container with material to be dispensed.
Figure 11B:
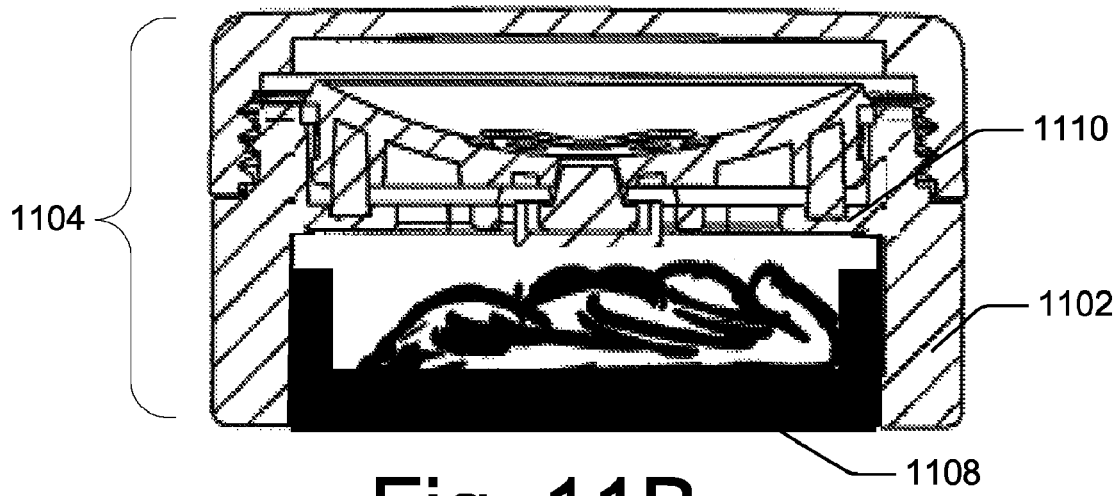
Figure 12:
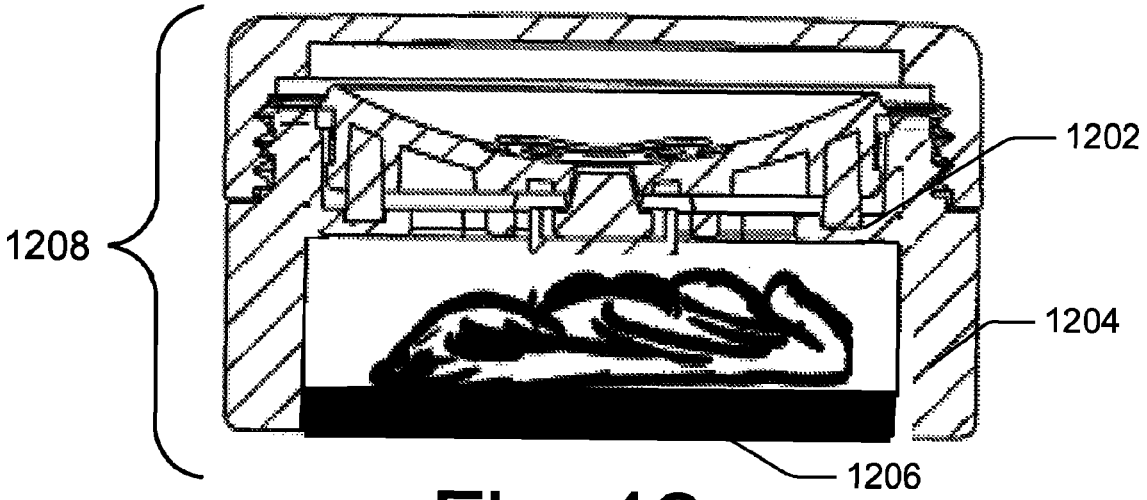
FIG. 12 depicts an alternate configuration utilizing a bottom cap to assist filling the container with material to be dispensed.

FIGS. 11A, 11B, and 12 depict alternate configurations in which the base 1102 of the container 1104 has an opening 1106. In these configurations, a bottom container 1108 or cap 1206 may be designed to engage or be fixed to base 1102 through a press fit, friction fit, threaded engagement, friction, glue, or other securing method or means. As shown in FIGS. 11A, and 11B, base 1102 has an integral first sifter 1110.

According to the implementation shown in FIGS. 11A and 11B, the bottom container 1108 may have side walls and an open top and may be filled with material 1112 to be dispensed. In this implementation, the cartridge may be prefilled before the cartridge is engaged with the base.

FIG. 11B shows the bottom cartridge 1108 as engaged with container 1102. Bottom container 1108 may be secured or fixed to the base 1102 by friction, glue, threaded engagement, ribs or other contoured features, or other suitable means.

FIG. 12 shows a variation of the container shown in FIGS. 11A and 11B, in which the first sifter 1202 and bottom portion 1204 are integral, but instead of cartridge 1108, the bottom portion is provided with a bottom cap 1206. This configuration allows a user to load powder into the bottom portion 1204 of the container 1208 by a process of inverting the container 1208, with the bottom cap 1206 removed, filling the bottom portion 1204 with material, and affixing cap 1206 to enclose the material within container 1208. The bottom cap 1206 may be engaged with the bottom portion 1204 by press fit, friction fit, threaded engagement, friction, glue, or other securing method or means. Ribs may assist in maintaining the engagement of bottom cap 1206 with bottom portion 1204. These variations of the cartridge, 1108, cap 1206, and/or the integral bottom portion 1102 and sifter 1110 may also be implemented in the implementations shown and described with reference to FIGS. 1 through 10.

Figure 13:
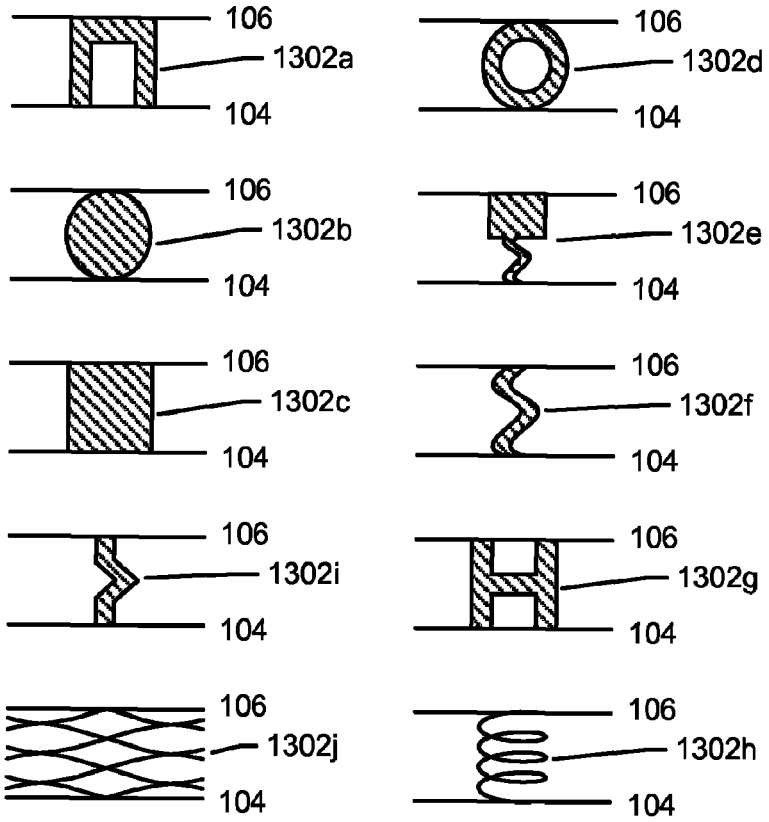
FIG. 13 depicts alternative cross sections of the resilient material.

FIG. 13 depicts variations of cross-sections that the resilient material 406 may have including a substantially U-shaped cross section 1302*a*, solid circular cross section 1302*b*, a solid square cross section 1302*c*, a hollow circular cross section 1302*d*, a combination square and generally sinusoidal or zigzagged cross section 1302*e*, a sinusoidal or zigzagged cross section 1302*f*, a substantially H-shaped cross section 1302*g*, a helical or spring shape 1302*h*, a chevron cross section 1302*i*, a wave spring 1302*j*, or other suitable shape. It should be noted that the resilient material may be continuous as a generally ring shaped member placed between the first and second sifters, or the resilient material may have one or more discrete components that operate to create and/or maintain a gap between the first and second sifters, such as sifters 106 and 104, when the displacement mechanism, such as cover 114, is removed or disengaged.

Figure 14:
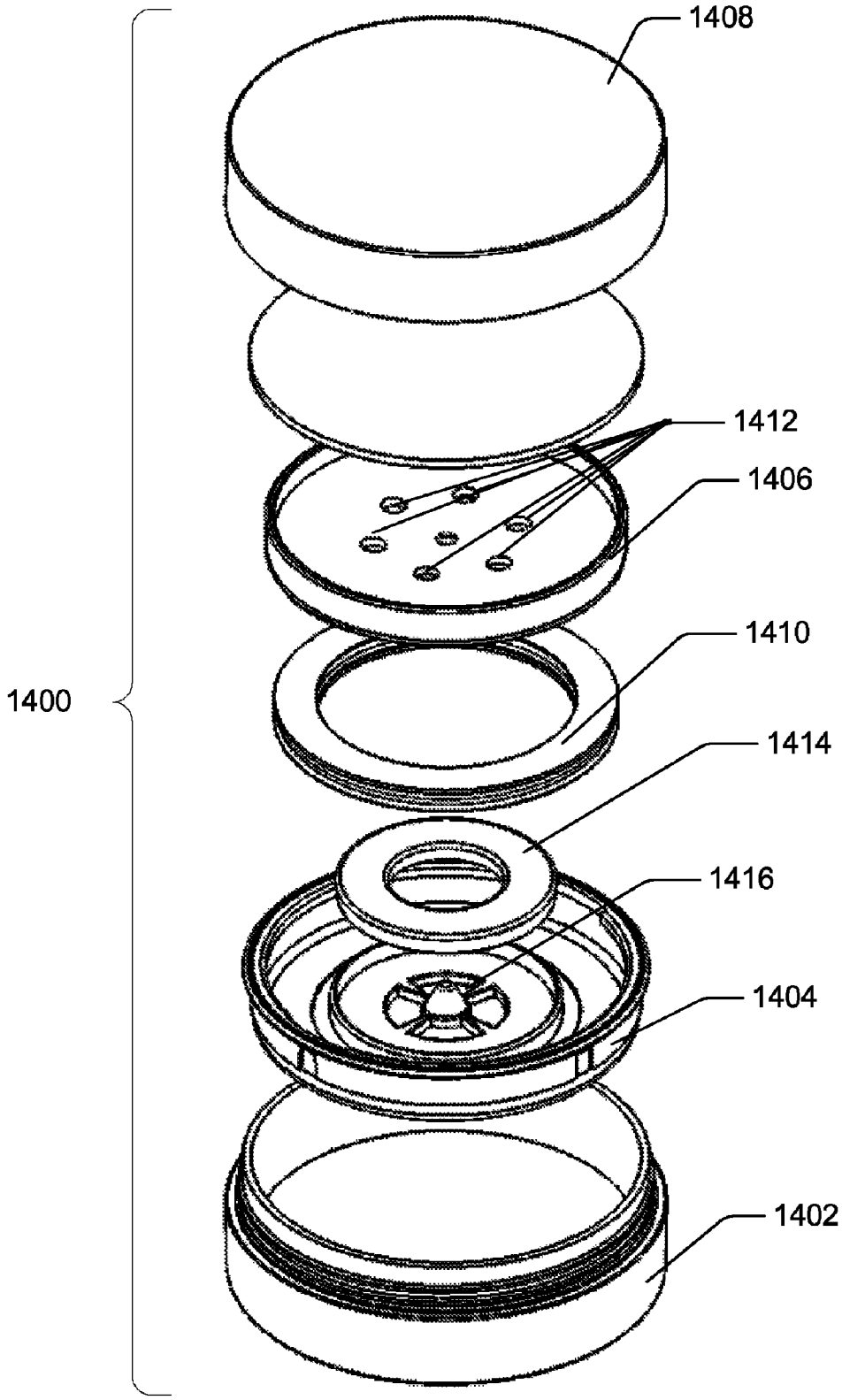
FIG. 14 shows an exploded view of a container having a compression sifter, according to another exemplary implementation.

FIG. 14 shows another exemplary implementation of a compression sifter. Like the configuration shown in FIG. 6, FIG. 14 shows another exemplary implementation in an exploded view of a container 1400 with a base 1402, first sifter 1404, second sifter 1406, and cover 1408. This implementation differs from that shown in FIG. 6 in that the resilient material 1410 is shown as a separate piece, and non-central holes 1412 of the second sifter 1406 are sealed by sealing ring 1414 when in the closed position. In another implementation not depicted, resilient material 1410 and sealing ring 1414 may be a single piece, or may be co-molded onto first sifter 1404.

Figure 15:
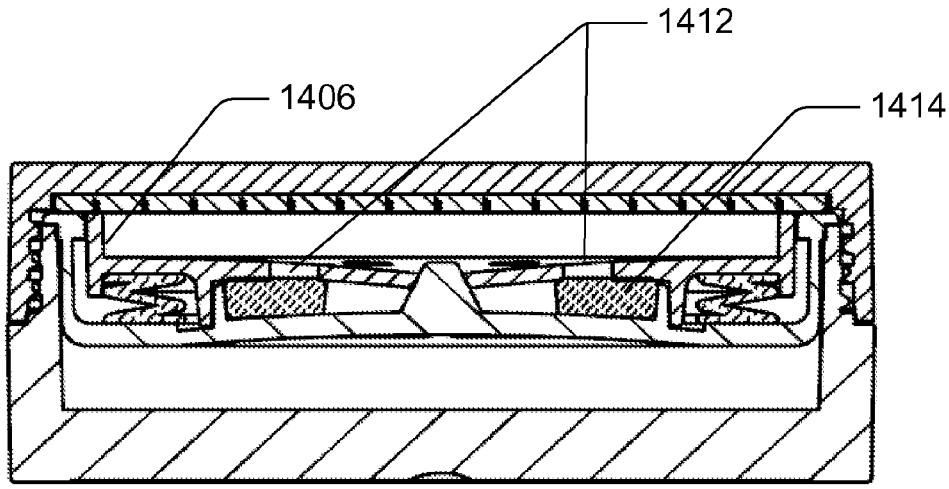
FIG. 15 shows a cross-sectional view of the container of FIG. 14, when in the closed position.

FIG. 15 shows a cross-sectional view of the container of FIG. 14, when in the closed position, where the sealing ring 1414 is obscuring the non-central holes 1412 of the second sifter 1406.

Figure 16:
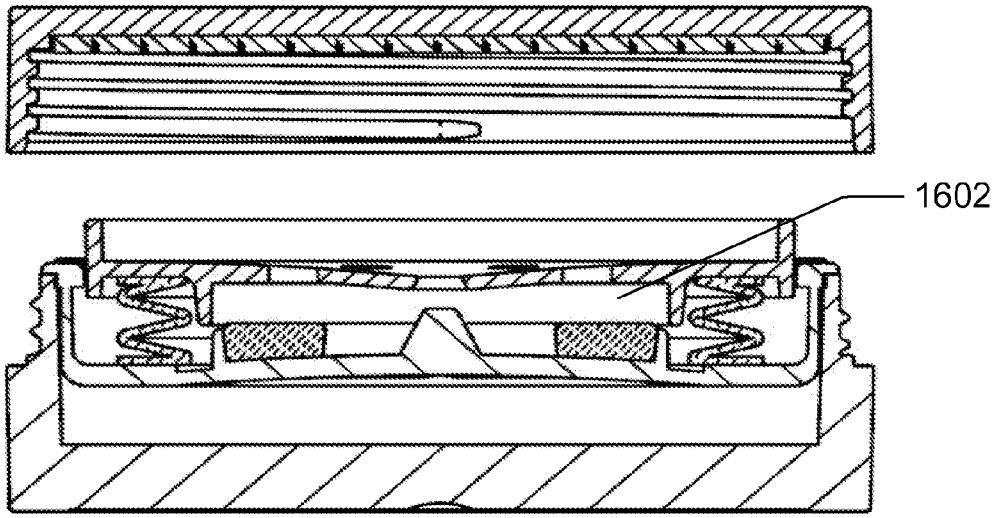
FIG. 16 shows a cross-sectional view of the container of FIG. 14, when in the open position.

FIG. 16 shows a cross-sectional view of the container of FIG. 14, when in the open position. The displacement mechanism, in this case, cover 1408 is disengaged. The resilient material 1410, may therefore recover, decompress, and/or elastically return to a less compressed, altered and/or deformed state as shown and described with reference to FIG. 15. This action creates a gap 1602 to permit passage of material from the base 1402 to the second sifter 1406.

Figure 17:
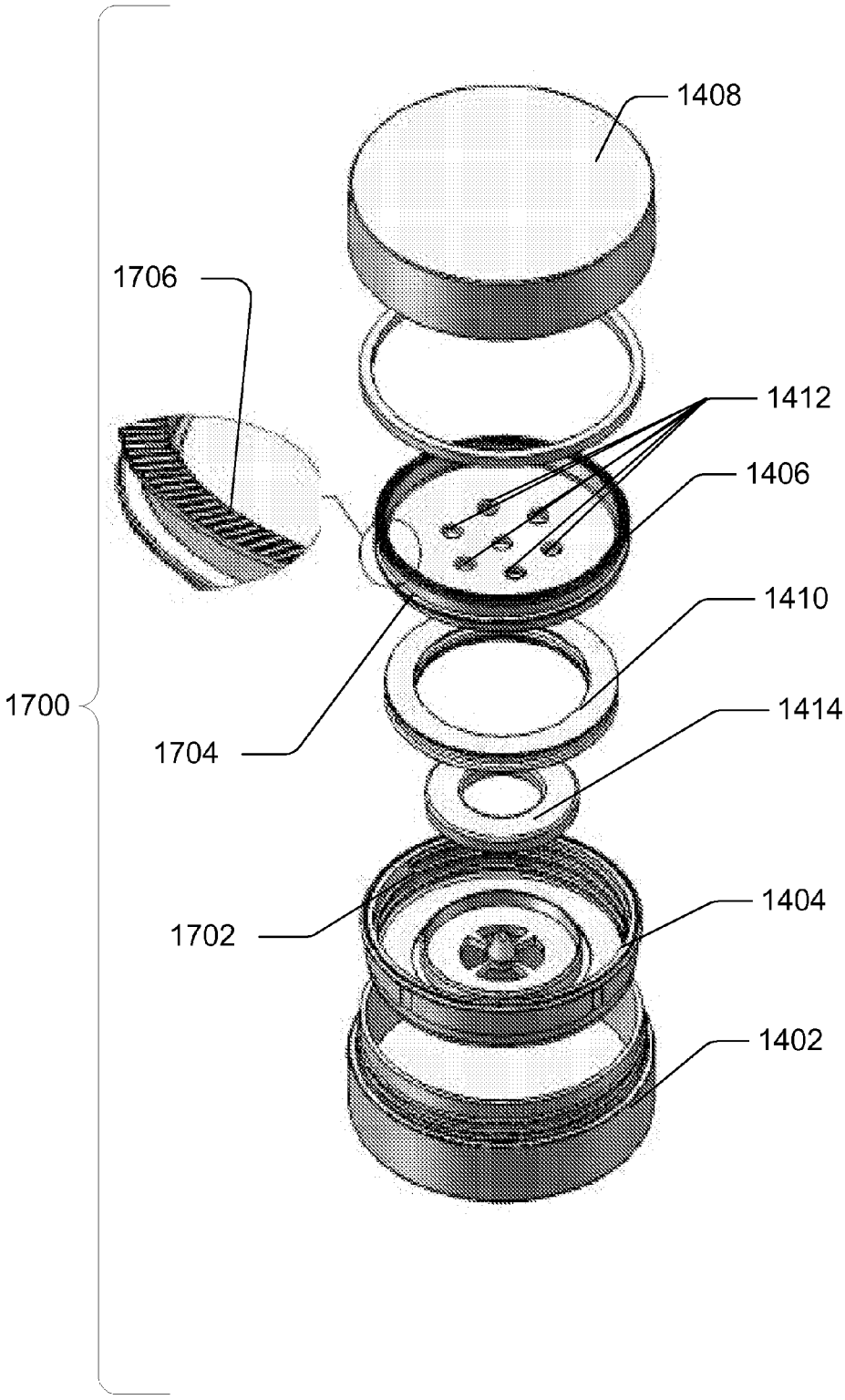
FIG. 17 shows an exploded view of a container having a compression sifter, according to another exemplary implementation.

Like the configuration shown in FIG. 14, FIG. 17 shows another exemplary implementation in an exploded view of a container 1700 with a base 1402, first sifter 1404, second sifter 1406, and cover 1408. This configuration may utilize resilient material 1410. Element 1410 may be entirely of resilient material, or a resilient elastomeric material may be overmolded onto a non-resilient piece to provide for a lesser amount of compression. This implementation differs from that shown in FIG. 14 in that the first sifter 1404 has threads 1702 which engage with matching threads 1704 on the second sifter 1406. Rotation of the cap 1408 engages cogs 1706 on the second sifter 1406 causing the second sifter to rotate, and, in turn, causing the resilient material 1410, if provided, to be compressed. This action engages holes 1412 with the seal 1414 and central protrusion 1416 (if any) on the first sifter 1404. The pitch of threads 1702 and corresponding threads 1704 may be different then the pitch of the threads on the base 1402 and the corresponding threads in the cap 1408 to facilitate operation. More particularly, the pitch of threads 1702 and corresponding threads 1704 may be steeper than the pitch of the threads on the base 1402 and the corresponding threads in the cap 1408.

Figure 18:
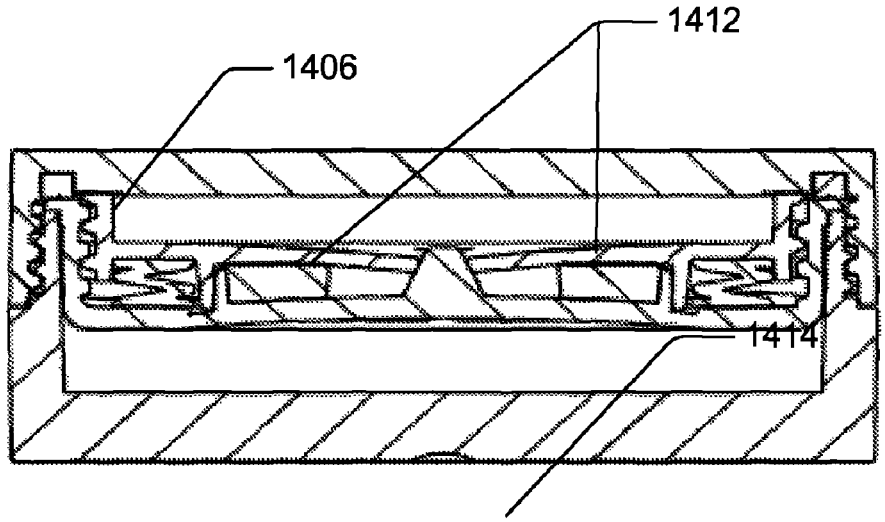
FIG. 18 shows a cross-sectional view of the container of FIG. 17, when in the closed position.

FIG. 18 shows a cross-sectional view of the container of FIG. 17, when in the closed position, where the sealing ring 1414 is obscuring the non-central holes 1412 of the second sifter 1406.

Figure 19:
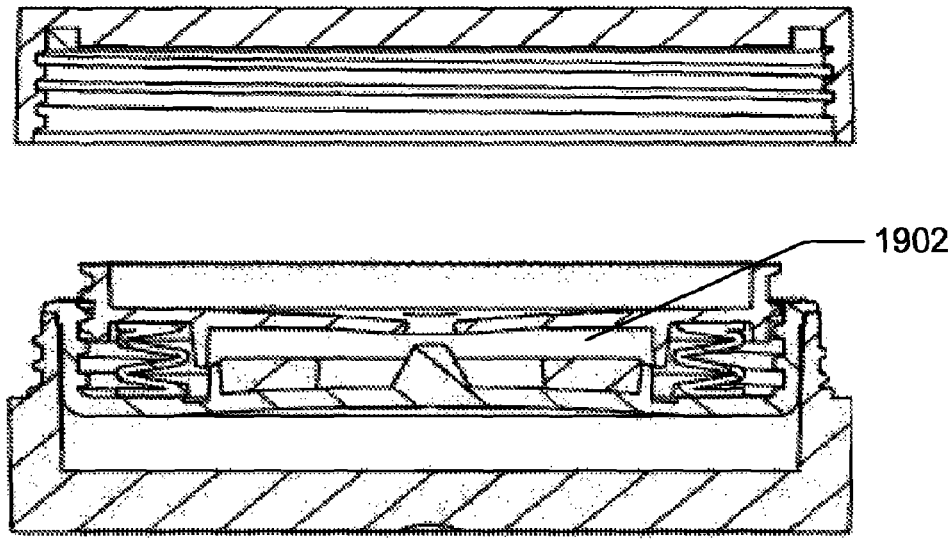
FIG. 19 shows a cross-sectional view of the container of FIG. 17, when in the open position.

FIG. 19 shows a cross-sectional view of the container of FIG. 17, when in the open position. The displacement mechanism, in this case, cover 1408 is disengaged. The resilient material 1410, may therefore recover, decompress, and/or elastically return to a less compressed, altered and/or deformed state as shown and described with reference to FIG. 18. This action creates a gap 1902 to permit passage of material from the base 1402 to the second sifter 1406. Of course, the gap could also be created by the rotation of the second sifter in relation to the first sifter.

Figure 20:
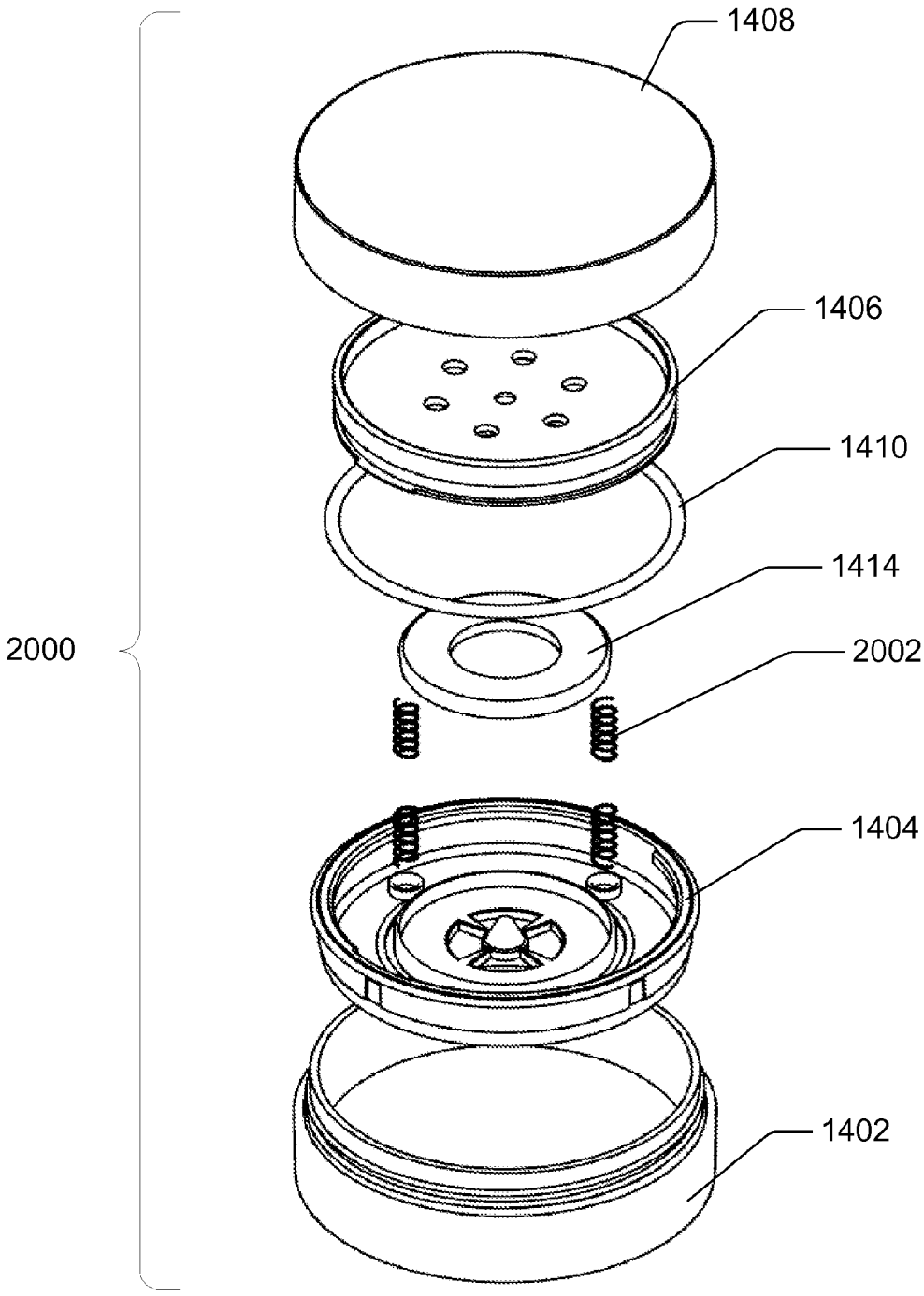
FIG. 20 shows an exploded view of a container having a compression sifter, according to another exemplary implementation.

Like the configuration shown in FIG. 14, FIG. 20 shows another exemplary implementation in an exploded view of a container 2000 with a base 1402, first sifter 1404, second sifter 1406, and cover 1408. This implementation differs from that shown in FIG. 14 in that elements 1410 and 1414 may not be resilient and springs 2002 or other suitable members are used to maintain a gap between first sifter 1404 and second sifter 1406.

Figure 21:
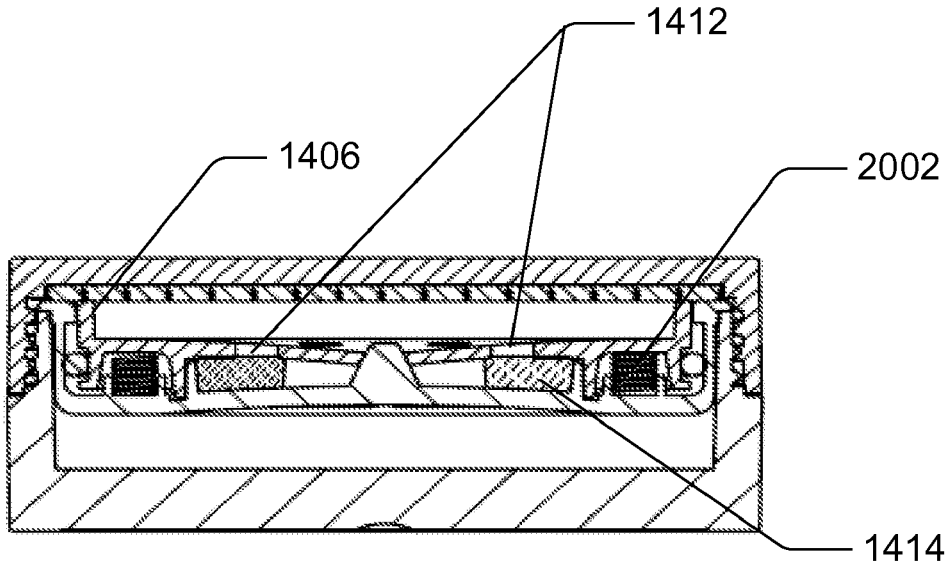
FIG. 21 shows a cross-sectional view of the container of FIG. 20, when in the closed position.

FIG. 21 shows a cross-sectional view of the container of FIG. 20, when in the closed position, where the sealing ring 1414 is obscuring the non-central holes 1412 of the second sifter 1406 and the springs 2002 are compressed.

Figure 22:
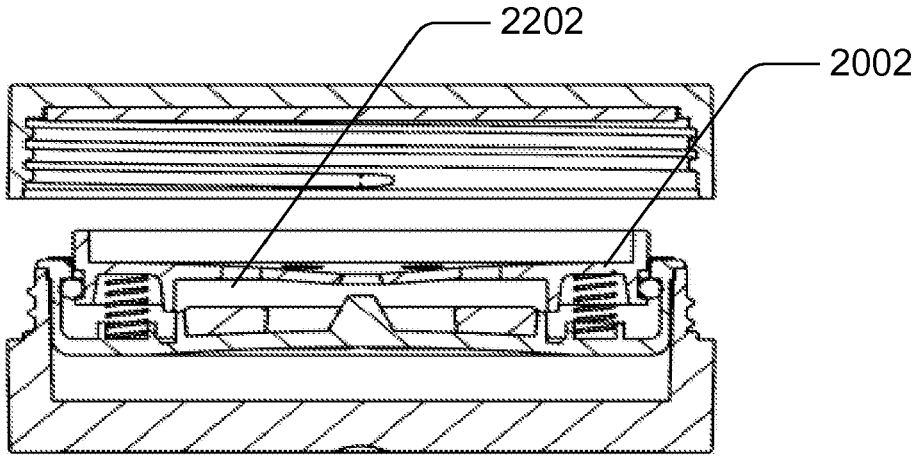
FIG. 22 shows a cross-sectional view of the container of FIG. 20, when in the open position.

FIG. 22 shows a cross-sectional view of the container of FIG. 20, when in the open position. The displacement mechanism, in this case, cover 1408 is disengaged. The springs 2002, may therefore recover, decompress, and/or elastically return to a less compressed, altered and/or deformed state as shown and described with reference to FIG. 21. This action creates a gap 2202 to permit passage of material from the base 1402 to the second sifter 1406.

Although details of specific implementations and embodiments are described above, such details are intended to satisfy statutory disclosure obligations rather than to limit the scope of the following claims. Thus, the claims are not limited to the specific features described above.

What is claimed is:

1. A container comprising:

a cover, and, a bottom portion including:

a base, a first sifter engaged with the base, a second sifter engaged with first sifter such that a gap is present between at least a portion of the first sifter and at least a portion of the second sifter to permit material to pass through the first sifter, the second sifters, and the gap; and a gasket adapted to maintain the gap between the portions of the first and second sifters when the cover is not engaged with the bottom portion, wherein the cover is adapted to engage the bottom portion displacing the second sifter toward the first sifter to prevent material from passing through the first sifter, the second sifter, and the gap.

2. A container according to claim 1, further comprising a spring to maintain the gap between the portions of the first and second sifters when the cover is not engaged with the bottom portion.

3. A container according to claim 1, wherein the gasket elastically compresses or elastically deforms when the cover is engaged with the bottom portion.

4. A container according to claim 1, wherein the gasket has a solid cross-section.

5. A container according to claim 1, wherein the gasket contacts the first sifter between a first sifting hole disposed on the first sifter and a perimeter of the first sifter, and wherein the gasket further contacts the second sifter between a second sifting hole disposed on the second sifter and a perimeter of the second sifter.

6. A container according to claim 1, further comprising an opening in the base for filling the base with the material to be dispensed and a cap for closing the opening.

7. A container according to claim 1, wherein one or both of the sifters have a protrusion which occludes a hole in the opposing sifter when the second sifter is displaced.

8. A container according to claim 1, wherein a sealing ring occludes a hole in the second sifter upon displacement.

9. A container according to claim 1, further comprising:

the first sifter being threadedly engaged with the second sifter; and the second sifter having a cog to allow engagement with the cap, whereby rotation of the cap rotates the second sifter thus altering the displacement between the first and second sifter.

10. A container according to 9, wherein the pitch of the threads between the first and second sifter differs from the pitch of the threads securing the cap.

11. A container according to claim 1, further comprising an opening in the base which accepts and engages a matching cartridge pre-filled with material to be dispensed.

12. A container according to claim 1, further comprising a supporting member extending between the first sifter and the base.

13. An apparatus comprising:

a base holding material to be dispensed;

a first sifter having a sifting hole, the first sifter being engaged to the base;

a second sifter having a sifting hole, the second sifter engaged to the first sifter;

a gasket; and a displacement mechanism to displace the second sifter toward the first sifter to prevent the flow of the material to the exterior surface of the second sifter when the displacement mechanism is placed into an engaged position, wherein the gasket maintains a gap between the first sifter and the second sifter when the displacement mechanism is placed into a disengaged position to allow material to flow through the sifting hole in the first sifter, the sifting hole in the second sifter, and the gap.

14. An apparatus according to claim 13, wherein the gasket is co-molded to the first sifter or the second sifter.

15. An apparatus according to claim 13, wherein the gasket is arranged between the first and second sifters, is located proximate to an outer edge of the first and second sifters.

16. An apparatus according to claim 13, further comprising an opening in the base and a cap to seal the opening.

17. An apparatus according to claim 13, further comprising a protrusion on at least one of the sifters, the protrusion to occlude the hole in the opposing sifter when the second sifter is displaced toward the first sifter.

18. An apparatus according to claim 13, further comprising the second sifter having a first side facing the first sifter and a second side opposite the first side, the second side including a concave surface.

19. An apparatus according to claim 13, wherein the first sifter is integral to the base.

20. A sifting apparatus comprising:

a first sifter, a second sifter engaged with the first sifter such that a gap is present between a portion of the first sifter and a portion of the second sifter to permit material to pass through the first sifter, the second sifter, and the gap;

a displacement mechanism operable to displace the second sifter toward the first sifter to prevent the flow of the material through the first sifter, the second sifter, and the gap, and, a gasket adapted to maintain the gap between the portions of the first and second sifters.

21. A sifting apparatus according to claim 20, wherein one or both of the sifters have a protrusion which occludes a hole in the opposing sifter when the second sifter is displaced toward the first sifter.

22. A container according to claim 1, wherein the gasket has a hollow cross-section.

23. A container according to claim 1, wherein the gasket is substantially U-shaped in cross-section.

24. A container according to claim 1, wherein the gasket has a cross section of which at least a portion of the cross-section is substantially sinusoidal or zigzagged.

* * * * *